US007094185B2

(12) United States Patent
Greenland

(10) Patent No.: US 7,094,185 B2
(45) Date of Patent: Aug. 22, 2006

(54) VERSATILE EXERCISE MACHINE

(76) Inventor: Darrell Greenland, 938-4th St., Apt. 109, Santa Monica, CA (US) 90403

( * ) Notice: Subject to any disclaimer, the term of this patent is extended or adjusted under 35 U.S.C. 154(b) by 439 days.

(21) Appl. No.: 10/302,365

(22) Filed: Nov. 22, 2002

(65) Prior Publication Data

US 2003/0134722 A1 Jul. 17, 2003

Related U.S. Application Data

(63) Continuation-in-part of application No. 10/053,325, filed on Jan. 17, 2002, now Pat. No. 6,905,446.

(51) Int. Cl.
*A63B 21/062* (2006.01)
*A63B 21/00* (2006.01)

(52) U.S. Cl. ..... 482/100; 482/138

(58) Field of Classification Search ..... 482/94, 482/98–101, 104, 135–137
See application file for complete search history.

(56) References Cited

U.S. PATENT DOCUMENTS 5,184,992 A * 2/1993 Banks ..... 482/104
5,569,133 A * 10/1996 Vittone ..... 482/98
5,653,666 A * 8/1997 Pantoleon ..... 482/112
5,669,859 A * 9/1997 Liggett et al. ..... 482/94
5,711,749 A * 1/1998 Miller ..... 482/135
6,811,521 B1 * 11/2004 Musso ..... 482/104

OTHER PUBLICATIONS

U.S. Appl. No. 10/053,325, filed Jan. 17, 2002, Exercise Device.

* cited by examiner

*Primary Examiner*—Gregory L. Huson
*Assistant Examiner*—Fenn C. Mathew
(74) *Attorney, Agent, or Firm*—Cislo & Thomas, LLP

(57) ABSTRACT

A self-spotting system for free weights enables the constructive use of such free weights without the need for a spotter. Using a free weight holder sliding along a rail, an adjacent free weight support provides and determines the lowermost travel of the associated free weight. In alternative embodiments, a parallelogram design for the free weight holder is set forth as well as a handle system which may optionally incorporate free weights and allow the use of the self-spotting system for single weights in conjunction with weights coupled to the handle system by a line or cable. Additionally, weight bar restraining and locking systems are set forth which provide secure means by which weightlifting bars can be secured into place, lowering the risk of slippage, dropping and the associated injury and damage that may occur when weights slip or fall.

17 Claims, 4 Drawing Sheets

VERSATILE EXERCISE MACHINE

CROSS-REFERENCES TO RELATED APPLICATIONS

This patent application is a continuation-in-part of U.S. patent application Ser. No. 10/053,325 filed Jan. 17, 2002 now U.S. Pat. No. 6,905,446 entitled Exercise Device which application is incorporated herein by this reference thereto.

BACKGROUND OF THE INVENTION

1. Field of the Invention

This invention relates to weight lifting machines and devices, more particularly to a self-spotting weight lifting machine where the weightlifter can lift weights until weary and be able to release the weights without dropping them.

2. Description of the Related Art

Weightlifting is well known in the art, and is a recognized Olympic sport. Additionally, weightlifting provides muscular development especially for the upper body and long muscles of the legs. Weightlifting gyms have become very popular places for activity and socializing as physical exercise generally forms a portion of most persons' days.

When lifting weights, much of the muscle development occurs once the muscles have been warmed up, and become weary from the weightlifting activity. This is particularly true for bodybuilders who lift small weights a great number of times in order to achieve better definition of particular muscle groups. Power lifters generally focus upon the amount of weight that they can lift, and also engage in "repetitions" where a weight of a certain amount is lifted a number of times repeatedly.

In most of these activities, free weights such as barbells or dumbbells are used. Because the weightlifting activity generally brings the weightlifter to the limit of his or her endurance, it is common to have a second person, called a "spotter," to help the person at the end of the repeated lifting cycle where the weightlifter's endurance begins to fail. The spotter is there to help the weightlifter lift the weight back onto a weight stand (that holds the weight) should the weightlifter be unable to return the weight to the stand. This is an important safety function, as the weight could either drop to the floor or on the weightlifter, possibly damaging the floor and/or injuring the weightlifter. The possibility of the latter case can arise when the weightlifter is reclined on a bench and lifting a barbell upwardly in a manner that, due to the weightlifter's reclining position, is directly over the weightlifter. When the weightlifter cannot return the weight to the stand, the barbell then descends by gravity onto the weightlifter. This can be particularly difficult if the barbell should engage the weightlifter's throat or windpipe. Generally, the weightlifter in distress would then turn the barbell to allow it to drop to the floor. However, this is a situation to be avoided, as it shows a lack of control and may injure the equipment as well as third persons.

Consequently, it is a shortcoming present in the art as there are a few, if any, exercise machines or exercise devices that allow the weightlifter to operate on his or her own without demanding the attention and time of a spotter.

There have been previous attempts made in the art with respect to self-spotting weightlifting devices.

U.S. Pat. No. 4,973,050 issued to Santoro on Nov. 27, 1990 for a Pulleyless Weightlifting Apparatus is directed to an apparatus for facilitating free weight exercises so as to prevent injury using barbells or dumbbells. The exercise apparatus 10 has a pair of bases 60, 62 supporting posts 34, 37 containing counterweights 72, 75 that are connected to cables 44, 47 that have connectors at the opposite end for connecting a barbell or dumbbells. The posts have a plurality of apertures for receiving stop pins 8 to limit the travel of the counterweights and also receive hooks 5 for supporting the barbell at a selected location. The weight lifting apparatus allows unrestricted movement of the weight bar or dumbbells, but provides safety to the user, but in a manner differing structurally from the present invention.

U.S. Pat. No. 5,407,403 issued to Coleman on Apr. 18, 1995 for a Forcer Repetition Assist Device is directed to a mechanical weight lifting partner that can be pro-programmed for operational parameters to allow predetermined weight lifting performance with the training partner being transparent to the user unless parameters are exceeded and assistance is necessary. The apparatus 1 has a vertical unit 92 that contains a control unit 58 containing a microprocessor-based control unit 58 that controls a motor controller that is coupled to a system containing a motor 56, clutch 52, encoder 35, as well as a roller chain drive with sprockets and a cable system. The apparatus is programmed through a keypad 72 so that with a barbell 2 or dumbbells 6, 12 connected to cable 22, exercises can be performed without the apparatus being involved unless the encoder determines that rates are being exceeded, then clutch is engaged and assistance is provided to the weight lifter.

U.S. Pat. No. 5,788,616 issued to Polidi on Aug. 4, 1998 for a Mechanical Weightlifting Machine is directed to a mechanical weight lifting machine that serves as a human spotter. The mechanical spotter 10 has a support frame 18 with a vertical support structure 25. An articulating mechanism 32 is provided that can selectively be used with dumbbells or a barbell. The articulating unit has a counterweight 44 that can be adjusted to balance out the weight of the machine so no resistance is felt by the user in raising or lowering free weights, if desired. Drive motor 60 and a foot control 58 are provided for weight adjustment. Rods 40 are suspended from the articulating unit with lower ends 42 that can be connected to a dumbbell or barbell. The downward swing of the weights are limited by stops 72 and the support frame includes a pair of weight rests 74. The disclosed structure does not allow for pivotal displacement in the horizontal plane.

U.S. Pat. No. 5,971,897 issued to Olson et al. on Oct. 26, 1999 for a Multi-Purpose, Natural-Motion Exercise Machine is directed to a multipurpose natural motion exercise machine permitting safe free-ranging motion. The machine has handlebars 26 that are supported on a bearing sleeve 20 that rides on horizontal shaft 16. Shaft 16 is coupled to main bearing sleeve 14 that rides on main shaft 12. Vertical bearing sleeve 14 has a weight bar 30 upon which a desired amount of weights are placed. A safety catch 38 is placed on the vertical shaft to limit the downward motion of the handles and a safety catch 36 is installed on the horizontal shaft 16. The user can provide repetitions of weight lifting using natural elliptical motions provided by bearing slides.

U.S. Pat. No. 4,998,723 issued to Santoro on Mar. 12, 1991 for a Cable Suspended Dumbell [sic] and Barbell Weightlifting Apparatus is directed to a cable suspended dumbbell and barbell weightlifting apparatus that provides safety to the user. The exercise apparatus 10 can support dumbbells 54 or a barbell 80 on the end of the two cables 58 that can be adjusted to a pre-selected height by positioning slider assemblies 44, 46 on guide track support members 40 and inserting key stops 32 through holes 60 in the guide track.

It can be seen that the art would be advanced by a self-spotting exercise device that would allow weightlifters to lift weights without risking injury or dropping the weights, as well as requiring the services of a spotter. This would further allow individuals to exercise with weights independently of others, as well as providing a safe means by which to do so.

This is particularly true for dumbbells, which are held individually in a single hand by the weightlifter. Additionally, other weight systems may also use the single hand style of a dumbbell, as opposed to the double hand style of a barbell in order to provide weightlifting resistance.

In some exercise machines, it may be of some advantage to limit the motion of the weigh lifter engaging in dumbbell-like activities. In this way, the dumbbell can be restrained and the weightlifter can focus on certain muscle groups.

The problem also arises in the art with respect to providing a restraint for a dumbbell or barbell such that it does not slip from a holder or the like. This allows the attachment of the dumbbell or other weight to a self-spotting device or otherwise. This provides an advantageous way in which dumbbells and/or barbells can be restrained and kept from falling to the floor and either damaging the weight or injuring a person.

SUMMARY OF THE INVENTION

In view of the foregoing disadvantages inherent in the known types of weightlifting devices now present in the prior art, the present invention provides new weightlifting mechanisms by which a weightlifter can engage in free weight-like exercise while enjoying self spotting and a greater degree of safety when pushing physical limits of weightlifting endurance.

The general purpose of the present invention, which will be described subsequently in greater detail, is to provide greater safety and enjoyment while lifting weights. The present invention provides not only new free weight-exercise apparatus, but also provides a weightlifting bar holder, and a free weight latching system, all of which are not anticipated, rendered obvious, suggested, or even implied by any of the prior art weightlifting devices or systems, either alone or in any combination thereof.

Among other things, the present invention provides a unique free weight holder means that allow the weightlifter to engage in free weight lifting activity while having a self-spotting feature in an adjustable manner.

In a first embodiment, a weightlifting frame is provided similar to ones that are often used in the art to support weightlifting elements. The weightlifting frame provides skeletal or other structural support for a free weight-spotting mechanism in conjunction with a free weight-holding mechanism. In one embodiment, a free weight support selectively and slidably engages a vertical post of the weightlifting frame. A separate rail parallel to the post allows sliding engagement of a free weight holder. The downward travel of the free weight holder is limited by the free weight support. Free weights are then attached to the free weight holder which enables the weightlifter to spot the free weights at the lowermost point of travel of the free weight holder along the rail.

In an alternative embodiment, a similar free weight holder slides along said at least one rail but a swinging framework in the form of a parallelogram allows the horizontal travel of the free weights with respect to said at least one rail.

In a third embodiment, a double shaft configuration provides greater restriction for the free weight holder. In this third embodiment, the free weights may be omitted as the free weight-holding mechanism serves as a means of attachment for a cable or a line coupled to weights associated with the weightlifting framework. This embodiment may provide both downward or upward resistance according to the weightlifter's preference.

In all these embodiments, the free weight holders may be joined with a single bar as for barbells as well as allowed to operate independently as for dumbbells.

Further, in order to hold the free weights or any weightlifting bar in place, a series of holders are provided that restrainably, but selectively releasably, allow the locking and unlocking of the weightlifting bar into the holder.

OBJECTS OF THE INVENTION

It is an object of the present invention to provide a self-spotting system for free weights.

It is another object of the present invention to provide greater safety for weightlifters engaging in free weight-lifting activities by providing a self-spotting mechanism for free weights.

It is yet another object of the present invention to provide free weight-holding mechanisms for use in association with the weightlifting frame.

It is yet another object of the present invention to provide manually-engageable weightlifting means that are adapted for use with a self-spotting mechanism.

It is also another object of the present inventor to provide a free range of motion for weights used in a self-spotting system.

It is yet another object of the present invention to provide a latching system for stably positioning free weights.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
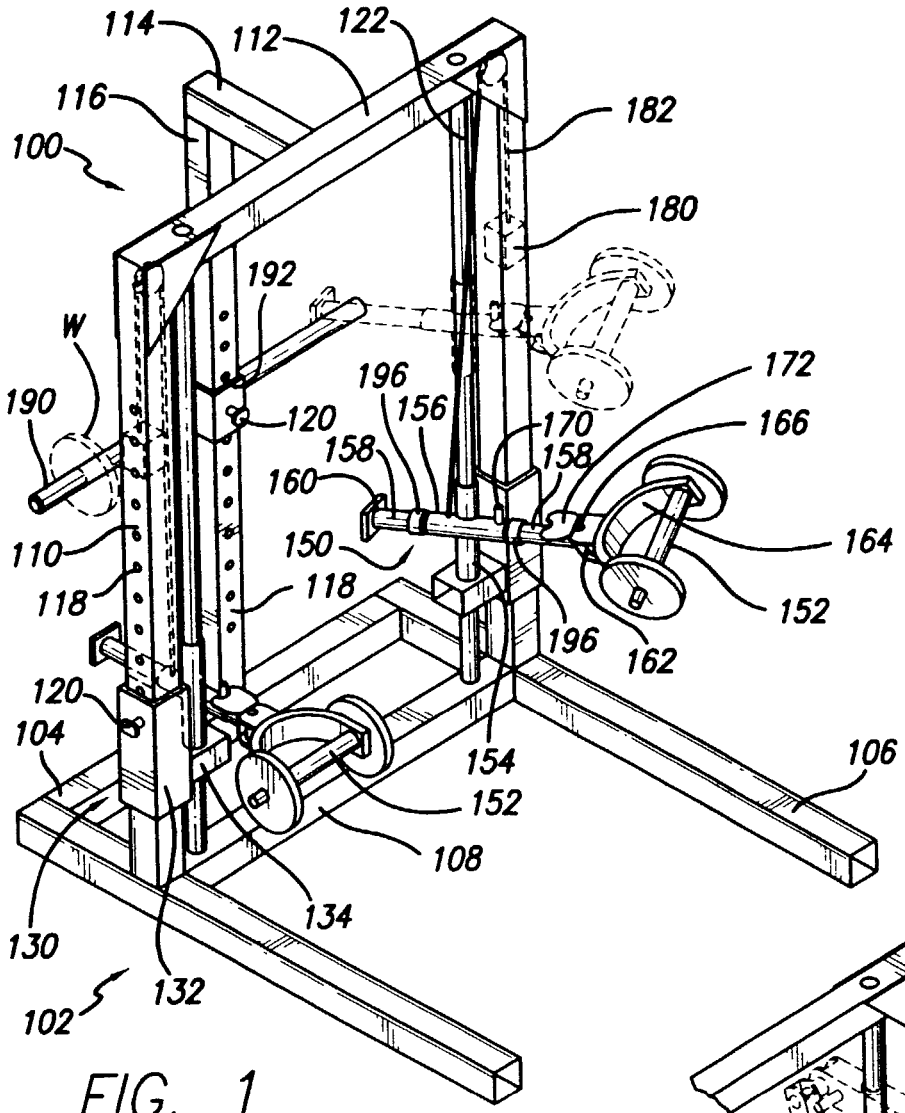
FIG. 1 is a right top perspective view of a weightlifting frame incorporating the free weight holders and supports of one embodiment of the present invention.

As shown in FIG. 1, a weightlifting frame 100 has a floor support 102 that has a rear crossbar 104 interconnecting to extending legs 106 in a U-shaped fashion. A middle crossbar 108 interconnects the extending legs 106 and is generally parallel to the rear crossbar 104. Upstanding posts 110 are interconnected by a top crossbar 112. As shown in FIG. 1, a rear extension 114 extends rearwardly from the top crossbar 112 and connects to a central rear upstanding post stop 160. Both the side upstanding posts 110 and the rear upstanding post 116 may be perforated by a series of spaced holes 118 in which a pin 120 may fit as it travels through a carriage, sleeve, or other holder in order to hold the carriage, sleeve, or holder in place with respect to the upstanding post 110, 116.

Inwardly adjacent to each of the two upstanding posts 110 are rails 122 which generally travel from the middle crossbar 108 to the top crossbar 112. The rails 122 may be permanently attached to the crossbars 108, 112 or may be disconnectable therefrom in order to enable other apparatus to engage the rail 122. The rail may be generally cylindrical in nature but may be another shape according to the materials available, needed, or desired.

The weightlifting frame 100 generally forms the environment in which the free weight-holding system of the present invention operates. As shown in FIG. 1, a free weight support 130 has a traveling carriage, or sleeve, 132, which circumscribes the upstanding post 110 with which it is associated. As used herein, the term "carriage" generally refers to any supporting mechanism, including sleeves, roller-supported mechanisms and supports, and the like. A support platform 134 connects to the base of the traveling carriage 132 but is able to slide along the rail 122. The support platform 134 circumscribes the rail 122 and is able to slide around the rail 122 as the free weight support 130 as a whole travels vertically with the traveling carriage 132 traveling along the upstanding post 110. As with all of the materials set forth herein, sturdy metals such as iron or steel may be used for the free weight support 130 as well as the weightlifting frame 100 and the other parts of the present invention and related systems.

The traveling carriage 132 may be coupled to the upstanding post 110 by a pin or the like traveling through the side of the traveling carriage and engaging a corresponding hole in the upstanding post 110. A series of holes 118 in the upstanding post 110 are selectably alignable with a central hole in the carriage 132. A pin 120 or similar element may then lock the carriage 132 in place with respect to the post 110 by traveling through each via aligned holes.

The support 130 serves as a support for the free weight holder 150. The free weight holder 150 serves to hold the free weight 152 and couple the free weight 152 to the rail 122. The free weight holder 150 has a riding carriage, or sleeve, 154 which travels along the rail 122. The riding carriage 154 may pivot about the rail 122. Sloped with respect to the riding carriage 154 and attached to the riding carriage 154 is a post carriage, or sleeve, 156. The post carriage 156 is sloped rearwardly such that the supported free weights 152 and tend to slide back towards the free weight post carriage 156. While an angle of approximately 5° is currently considered to be sufficient, angles of about 0°–10° may be found to be beneficial. The post carriage 156 may be approximately the same length as the riding carriage 154 both of which have a cylindrical configuration so as to provide lateral support or restraint for the rail or posts which travel through them respectively.

A post 158 travels and can reciprocate through the post carriage 156 and terminates at a rear end in a post stop 160. The front end of the post 158 is attached to a joint 162 to which a generally curved free weight-holding portion 164 is attached.

The joint 162 allows the free weight-holding portion to pivot about a pin or other hinge portion 166 while the post 158 itself may rotate within the post carriage 156. This allows radial pivoting of the free weight 152 with respect to the post 156 and allows pivoting for the free weight 152 as well. Coupled with the ability of the riding carriage 154 to pivot about and move vertically with respect to the rail 122, the self-spotting system set forth herein provides a free range of motion for the free weight in horizontal, vertical, and circular directions. Additionally, as each free weight holder 150 operates independently of the other, a weightlifter can articulate the free weights as he or she sees fit. Generally, only when both the free weight-holding portions 164 are linked as by a bar (as for a barbell) do the free weight holders operate together.

A small alignment post 170 may be engaged by an open fitting 172 and such engagement is shown on the free weight holder 150 closest to the viewer in FIG. 1. The open fitting aligns the free weight 152 in a manner that allows ready manual engagement of the free weight 152. When the free weight holder is disposed as shown in FIG. 1 (for the free weight closest to the viewer), the free weight 152 is held out of the way but aligned such that it can be easily grasped by the weightlifter.

A counterweight 180 may be connected by a line or cable 182 to the post carriage 156 or other portion of the free weight holder 150. The counterweight 180 may generally weigh the same as the free weight holder 150 less the free weight 152. In this way, the free weight holder 150 has its weight matched by the counterweight 180 and the weight of the free weight 152 serves as the only weight for resistance for the weightlifter.

At the rear of the weightlifting frame 100 is a free-standing bar 190 that is attached to a carriage 192. The carriage 192 is held in place by the pin 120 engaging one of the holes 118 on the rear upstanding post 116. The free-standing bar 190 may serve as a place for holding weights W, for holding up the free weight post 158 and free weight holder 150, or otherwise according to the convenience of the weightlifter. As shown in phantom in FIG. 1, the free weight holder and related structures may be supported by free-standing bar 190 via the free weight post 158.

In use, the self-spotting free weight system of the present invention uses the support 130 and its ability to support the free weight holder 150 and to control the lowermost height to which the free weight holder 150 may descend. Using the through pin 120 and hole 118 structure shown in conjunction with the freestanding bar 190, the traveling carriage 132 may be adjustably positioned along the associated upstanding post 110 in order to control the position of the support platform 134. The riding carriage 154 of the free weight holder 150 can travel no lower than the top of the support platform 134. This creates a self-spotting mechanism that allows the weightlifter to lower the free weight 152 while having the riding carriage 154 ultimately contact the top of the support platform 134. As the weightlifter continues to lower his hands or arms, the weight of the free weight is then shifted from the weightlifter to the support 130 via the support platform 134. In this way, a self-spotting mechanism is created that is adjustable due to the vertically adjustable nature of the support 130.

The reciprocatable travel of the post 158 through the post carriage 156 allows the weightlifter some horizontal distance through which he can move the free weight 152. The post stop 160 and the joint 162 and/or open fitting 172 serve to limit the travel of the post 158 through the free weight post carriage 156.

As shown in FIG. 1, lock collars 196 may be used to further limit the reciprocating activity of the opposed 158 as it slides through the sleeve 156. The lock collars 196 circumscribe the post 158 on either side of the sleeve 156 and may preferably be detachable from the post 158 so as to provide the greatest distance for post reciprocation.

In one embodiment, the lock collars 196 may be in the form of two halves that are screwed together in order to restrict the movement of the post 158. Other means known in the art or developed in the future may also be used for such lock collars. One advantage to having lock collars 196 is that the post 158 can be restricted to a single position with respect to the rail 122 and sleeve 156. While the post 158 may be able to turn within the sleeve 156, it would not be able to travel or reciprocate through the sleeve 156 thus restraining the post and the free weight 152, preventing it from traveling with respect to the sleeve 156 or rail 122.

Figure 2:
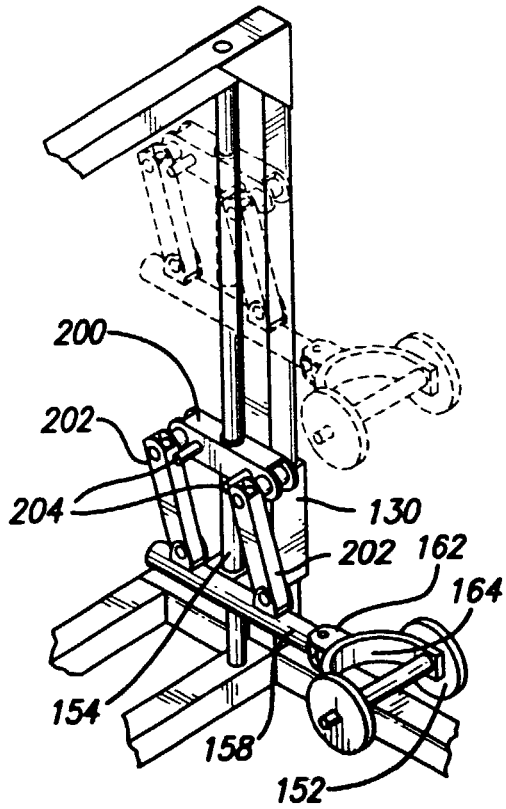
FIG. 2 is a partial view of a weight lifting frame such as that in FIG. 1 showing an alternative embodiment of the free weight holder.

An alternative embodiment of the present system is shown in FIG. 2 where the free weight 152 is attached to a post 158. The post 158 is suspended from a lateral support 200 via descending pivoting arms 202. The descending pivoting arms 202 are pivotably connected to both the post 158 and the lateral support 200. As such, these four elements (the lateral support 200, the two descending pivoting arms 202, and the free weight post 158) form a shifting and reciprocatable parallelogram where the post 158 is always held parallel to the lateral support 200 via the two descending arms 202. Restraining posts 204 limit the angular travel of the descending arms 202 by interfering with their further angular travel. Both of the restraining posts are to the inside of each descending arm 202 with the rear post limiting the forward travel of the rear descending arm 202 and the front post limiting the rearward travel of the front descending arm 202. However, the needed or desired limitation of the descending arms 202 could also be achieved by placing the restraining posts 204 to the outside of each descending arm 202. Alternatively, the restraining posts 204 could flank a single descending arm 202 to achieve a similar, if not the same, effect.

The lateral support 200 may be attached to the top of the riding carriage 154. A support 130 is then provided in a similar manner as for the embodiment shown in FIG. 1 and the riding carriage 154 engages the support 130 in a similar manner thereto. The post 158 as shown in FIG. 2 has no post stop 160 as the rearward travel of the post 158 is instead limited by the restraining posts 204. A joint 162 is coupled to the post 158 as shown in FIG. 2, which is likewise coupled to a free weight-holding portion 164. The joint 162 and free weight-holding portion 164 as shown in FIG. 2 operate independently in a manner similar to that as shown in FIG. 1.

In FIG. 2, the operation of the riding carriage 154 and support 130 are generally the same as those set forth above for the embodiment shown in FIG. 1. The embodiment shown in FIG. 2 provides an alternative embodiment for the horizontal articulation of the post 158 and may provide certain other advantages for the free weight weightlifter.

Figure 3:
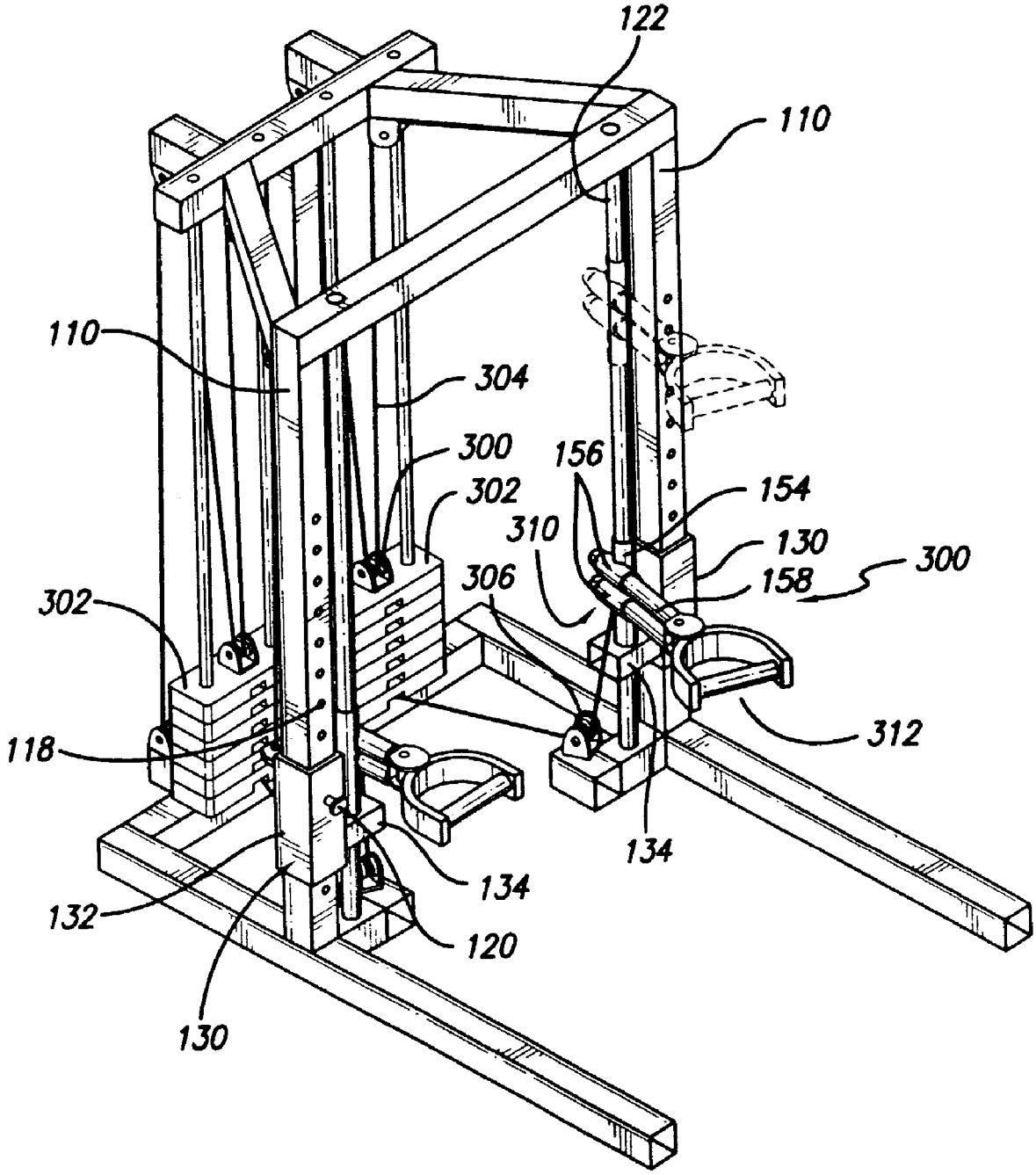
FIG. 3 is a right top perspective view of a weightlifting frame incorporating a free weight self-spotting mechanism according to the present invention and a handle system similar to the free weight holders of FIGS. 1 and 2 with the free weight holder attached by line to a series of pulleys and weights.

In FIG. 3, a handle system 300 (which may optionally be used in conjunction with free weights) is shown in conjunction with a series of weights 302 coupled to the handle system 300 by means of a line 304 and pulleys 306.

As shown in FIG. 3, the riding carriage 154 is supported by the handle system support 130. However, dual post carriages 156 engage dual posts 158 to provide additional lateral support for the posts 158 while enabling the posts 158 to articulate and reciprocate laterally. Although the post carriages 156 and posts 158 are doubled in the embodiment shown in FIG. 3, the operation of the handle system 300 is similar to that as shown in FIG. 1 except that any free weight weights are optional as the weights 302 substitute for the weight previously present with the free weights 152 (FIG. 1).

In operation, the handle systems 300 operate independently of one another, such operation similar to that as shown in FIG. 1 as the support 130 limits the downward travel of the riding carriage 154 when the riding carriage 154 engages the top of the support platform 134. The support 130 may be adjustably disposed along the vertical length of the associated upstanding post 110 by means of a through pin 120 which travels through the traveling carriage 132 and engages one of a series of holes 118 in the upstanding post 110.

The cable 304 attaches to the post carriages 156 from either the bottom or the top. The other end of the cable may then be attached to the support 130 or other static attachment point. As configured in FIG. 3, the resistance delivered by the cable 304 to the post carriages 156 is downward in nature. Consequently, when a weightlifter pushes up on the free weights 152, the weightlifter then experiences a downward resistance (or, a resistance to the upward motion) due to the weights 302 and their attachment via pulleys 306 to the cable 304. By reversing the ends of the cable 304 so that the lower cable attachment to the post carriages 156 is switched with the attachment to the support 130, upward resistance is delivered by the cable 304 to the free weight post carriages 156. This embodiment may require some temporary shortening or attachment of the cable 304 to the post carriages 156 so that the handle system 300 is held in a suspended position above the support 130 as indicated in phantom in FIG. 3. The weightlifter can then exert downward pressure on the handle 312 and perform exercises such as "lat pulls" and the like against the resulting upward resistance.

Note should be taken that when, as shown in FIG. 3, the holder 310 is slid upwardly, due to the fixed relative relationship between the support 130 and the holder 310, the ensemble can be slid together up and down the associated post 110 and rail 122 with significant ease. The cable 304 merely slides along the pulleys 306 and the tension on the cable 304 stays the same.

As with the embodiments shown in FIGS. 1 and 2, the handle systems 300 shown in FIG. 3 each operate independently unless a pole, bar, or rod are substituted for the handles 312 and couple the two handle systems 300 together. Additionally, each of the handle systems 300 as shown in FIG. 3 pivot circularly about the rail 122 and the posts 158 can travel and reciprocate through the post carriages 156 to provide vertical, horizontal, and circular travel thereby imparting a free range of motion to the handles 312 and to the handle systems 300 as a whole.

Figure 4:
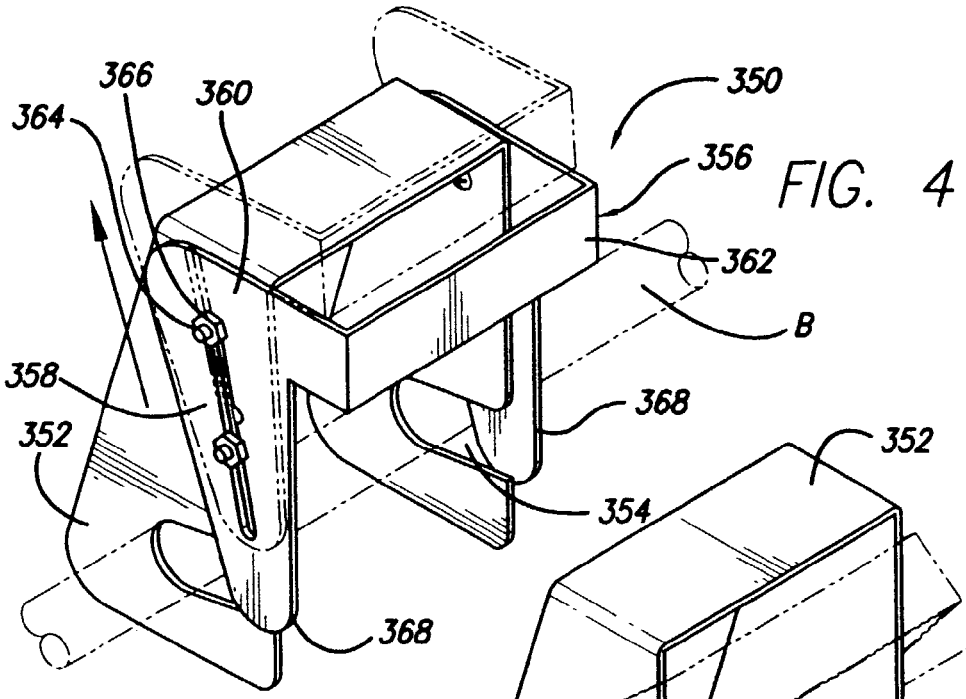
FIG. 4 is right top perspective view of a weightlifting bar holder.
Figure 5:
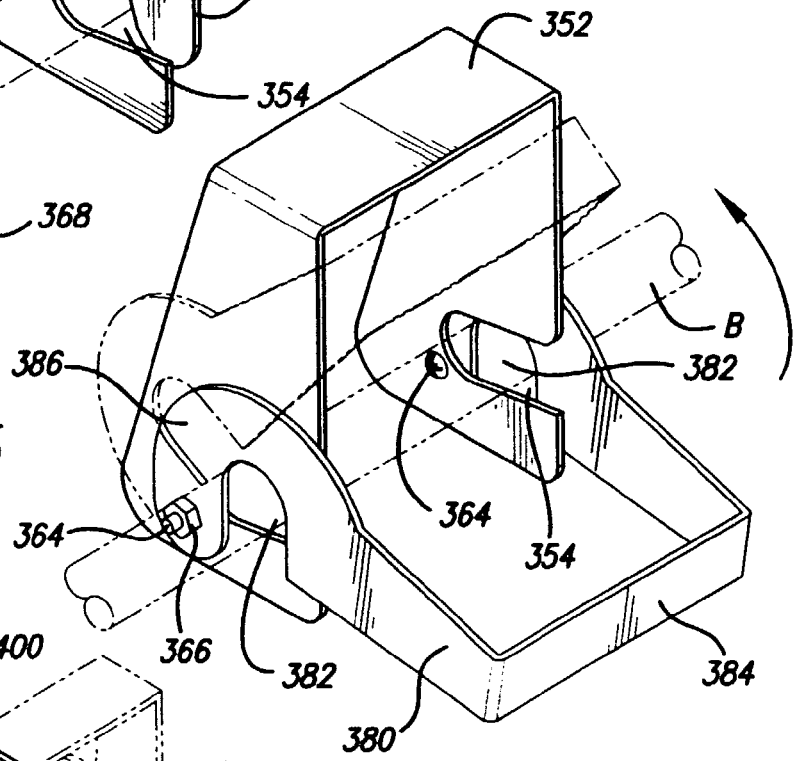
FIG. 5 is a right top perspective view of an alternative embodiment of a weightlifting bar holder.
Figure 6:
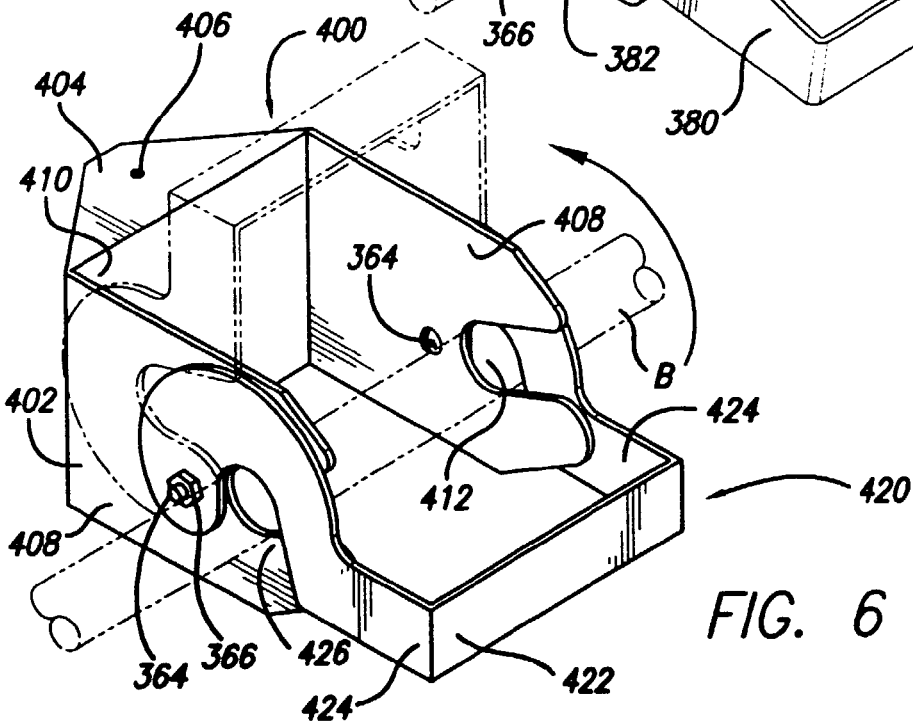
FIG. 6 is a right top perspective view of a second alternative embodiment of a weightlifting bar holder.

In FIGS. 4–6, a number of alternative embodiments for a weight bar holding system are shown. For all of the embodiments, the weight bar held by the weight bar holder is held in place and cannot escape from the weight bar holder until the restraint is lifted by the weightlifter or otherwise. This holds the weight bar in place and ensures that it does not move, slip, or slide from its position in the weight bar holder. In FIG. 4, a first embodiment of the weight bar holder 350 has a main holding chassis 352 which defines a forward facing slot 354 into which the weightlifting bar B may fit. Two such forward facing slots 354 are present in an aligned and parallel fashion such that the length of the bar is properly disposed in the forward facing slots. A sliding restraint 356 has opposing slots 358 on either side of the sliding restraint and parallel to the sides of the main chassis 352. As shown in FIG. 4, the opposing slots are defined in side elements 360 that are a part of the sliding restraint 356. The side elements are connected by a front handle 362 which projects outwardly from the front of the main chassis 352 to provide room for fingers to engage the front handle 362 when it is in its bar-restraining position. A sliding restraint 356 slides along bolts 364 held in place by nuts or the like 366 with the length of the opposing slots 358 controlling the length of travel of the sliding restraint 356. Lower descending restraint elements 368 serve to lock the bar B into place when it is set into the forward facing slots 354 of the main chassis 352. Once the bar B is in place, the downward travel of the sliding restraint 356 serves to position the lower descending restrained elements 368 in contact with the bar B and to lock the bar B into the forward-facing slots. Until the sliding restraint 356 is lifted, the bar B cannot travel from the forward-facing slots 354 of the main chassis 352 as the forward-facing slots 354 only allow travel of the bar B forward in a manner enabling travel of the bar B from the slots but this direction of travel is obstructed by the lower descending restraint elements of the sliding restraint 356.

In FIG. 5, the main chassis 352 engages the bar B with its forward facing slots 354. The restraint holding the bar B in the forward facing slots 354 pivots instead of slides but blocks the exit for the bar B from the forward facing slots 354. The pivoting restraint 380 may be pivotably coupled to the main chassis 352 near the base of the main chassis adjacent the rear portion of the forward facing slots. Bolts 364 secured by nuts 366 may serve as means by which a pivoting connection is provided between the main chassis 352 and the pivoting restraint 380. The pivoting restraint pivots around the main chassis 352 which articulates inside the pivoting restraint 380.

The pivoting restraint 380 has two parallel slots 382 which enable the pivoting restraint 380 to engage the bar B. Preferably, the parallel slots engage the bar B to hold the bar B at its rearmost point in the forward facing slots 354 of the main chassis 352. By grasping or engaging a top handle 384 of the pivoting restraint 380, the parallel slots 382 situated in side elements 386 are brought to bear upon the bar B and lock it into place, preventing it from exiting the forward facing slots 354 of the main chassis 352.

In FIG. 6, the free weight holder 400 has a box-shaped main chassis 402 which is generally U-shaped in configuration and has a rear extension 404 having a generally central hole 406 through which a pin or the like may engage the main chassis 402. Two side elements 408 extend forwardly from a rear panel 410 and terminate in diagonally upwardly parallel slots 412. The slots 412 allow a weightlifting bar B to be fitted therein and to be engaged by the side elements 408. A pivoting restraint 420 is pivotably connected to the outside of the side elements 408. The pivoting restraint 420 has a top handle 422 and two side elements 424. The side elements 424 define parallel slots 426. In so defining the parallel slots 426, the side elements 424 curve around the area where the parallel slots 426 are defined. The distal end of the side elements 424 are pivotably attached to the main chassis 402 by means of nuts and bolts 364, 366. As for the pivoting restraint 380 of the embodiment shown in FIG. 5. The pivoting restraint is pivoted to an open position where the diagonally upwardly parallel slots 412 of the main chassis are open and available to receive a weightlifting bar B. The weightlifting bar B is then fitted into the parallel slots 412. The pivoting restraint 420 is then pivoted about the bolts 364 with the parallel slots 426 of the pivoting restraint 420 engaging the weightlifting bar B. Once so engaging the weightlifting bar B, the side elements 424 obstruct the travel of the weightlifting bar B from the diagonally-upwardly parallel slots 412 of the main chassis 402 effectively locking the weightlifting bar B into place yet allowing the easy removal of the weightlifting bar B by the upward pivoting of the pivoting restraint 420. The upward disengagement of the pivoting restraint 420 from the weightlifting bar B opens the diagonally-upwardly parallel slots 412, enabling the removal of the weightlifting bar B from the diagonally-upwardly parallel slots 412.

The operation of the pivoting restraint 420 in FIG. 6 is similar to that as shown in FIG. 5. The operation of the main chassis in FIG. 5 is similar to the operation of the main chassis shown in FIG. 4.

Figure 7:
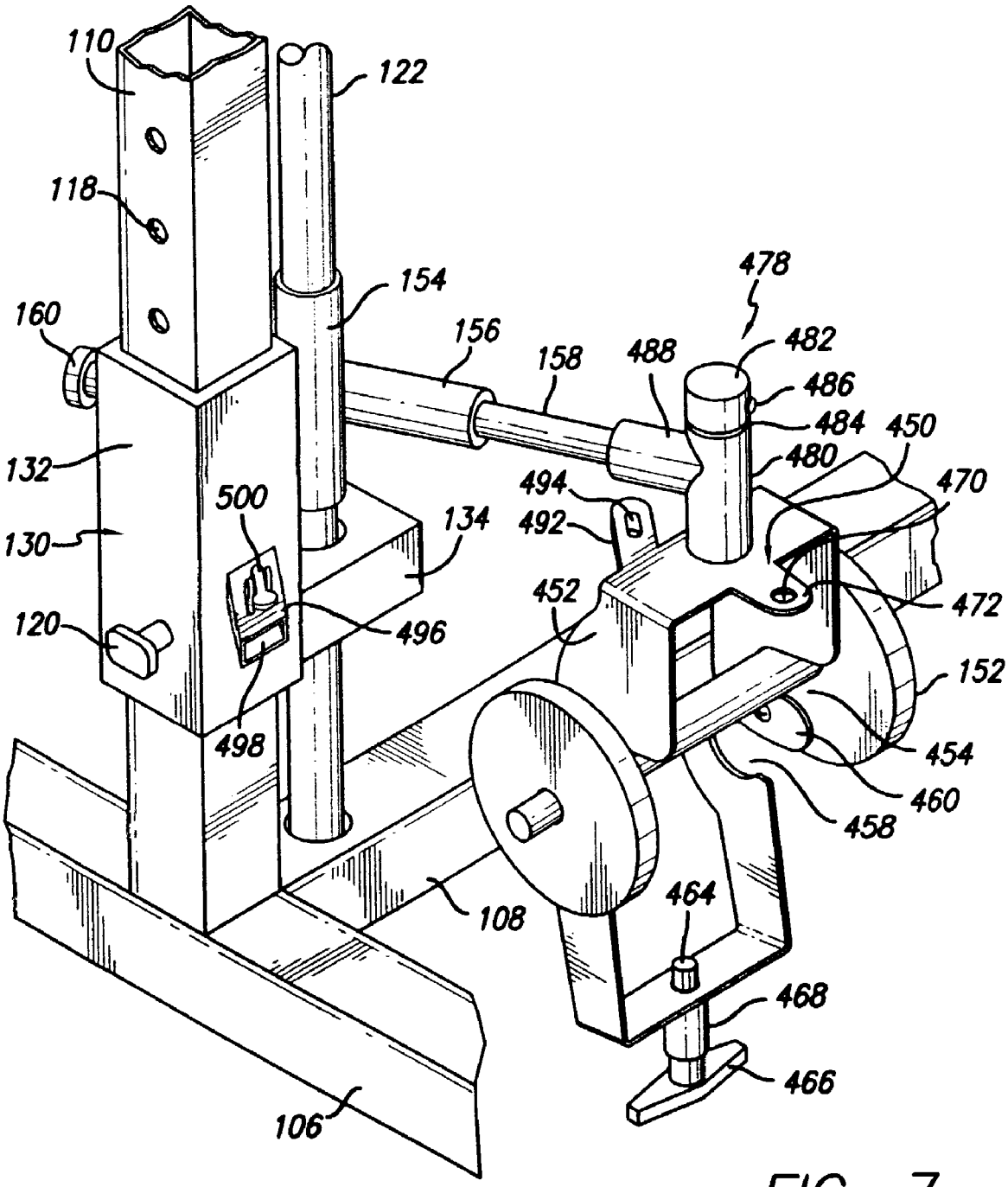
FIG. 7 is a right top perspective view of an alternative free weight holder having a latching mechanism to connect it to the sliding support.

In certain embodiments, it may be of some advantage to attach the free weight 152 or other weight to the weightlifting frame 100 or other structure attached to the weightlifting frame 100. FIG. 7 shows such an embodiment where the free weight 152 is removably captured in a bracket 450 that can be attached to the sliding support 130.

As shown in FIG. 7, the bracket 450 has an upper bracket half 452 which is somewhat similar to the brackets shown in FIGS. 4–6. The upper bracket half is generally U-shaped in structure and defines an open slot 454 into which the handle of the free weight 152 may travel. As shown in FIG. 7, the lower bracket half 456 also defines an open slot 458 which serves to trap the handle of the free weight 152. The lower bracket half 456 is pivotably attached to the upper bracket half 452 at a pivot 460 which as shown in FIG. 7 may be a bolt. The handle of the free weight 152 is placed within the open upper slot 454 and then the lower bracket half is pivoted on the pivot 460 such that the open slot 458 of the lower bracket half 456 also engages the handle of the free weight 152 to trap the handle of the free weight 152 between the upper bracket half 452 and the lower bracket half 456. A pin 464 may be coupled to a handle 466 that controls the operation of the pin 464 via a spring-loaded or other housing 468. A matching hole 470 defined in a prominence or projection 472 is engaged by the pin 464 in order to hold the upper and lower bracket halves 452, 456 together. This holds the free weight 152 in place and prevents it from disengaging the bracket 450.

The bracket is attached to the post 158 by a fitting 478 that has a bushing 480 within which a pin or small rod (not shown) may pivot. The pin terminates in a head 482 which is separated from the bushing 480 by a seam 484 as shown in FIG. 7. A screw, bolt, or spring-loaded button, or otherwise 486 may serve to hold the bracket 450 pivotably engaged by the bushing 480. Engagement of the button 486 may serve to free the bracket 450 from the bushing 480 in a process that disassembles the fitting 478. A collar 488 may be a part of the fitting 478 and serve to attach the fitting 478 to the post 158.

The upper bracket half 452 may also have a rear prominence or projection 492 which defines a rear aperture or hole 494. As can be seen in FIG. 7, the rear projection 492 is at an angle to the upper bracket half 452. A mating, or receiving, portion of a latch 496 has an angled or other aperture 498 which receives the rear projection 492. A spring-loaded pin (not shown) having a handle or lever 500 is engaged by the rear aperture 494 of the rear projection 492 when the rear projection 492 slides into the angled aperture of the receiving latch portion 496. As the sleeve 154 can slidably pivot about the rail 122 and as the post 158 can slide or reciprocate through the sleeve 156, the two portions of the latch 492, 496 can be brought into contact and engaged to hold the bracket 450 and any attached free weight 152 into place relative to the traveling sleeve 132 of the support 130.

Any number of configurations of the bracket 450 can be advantageously used in the present system and those brackets or bar holders shown in FIGS. 4–6 might easily be adapted for such a bracket 450 as shown in FIG. 7. The bracket 450 and associated parts can generally support a dumbbell of approximately 100 pounds. The latching of the bracket 450 is particularly advantageous when loading or unloading weights from the free weight 152.

While the present invention has been described with regards to particular embodiments, it is recognized that additional variations of the present invention may be devised without departing from the inventive concept. For example, while dual weight stacks have been depicted in the drawings, it may be desirable in some instances to use a single weight stack manipulable by the dual riding carriages and such modifications are readily apparent to those of ordinary skill in the art as to the cable support systems modification for said weight stack.

Further, those of ordinary skill will recognize that conventional sleeves having recirculating ball linear bearings are generally utilized where the reciprocating rods are used.

What is claimed is:

1. An exercise machine for enabling exercise with free weights comprising:

a weightlifting frame having a floor support for supporting said weightlifting frame upon a floor and having first and second oppositely opposed side upstanding posts coupled together by said floor support;

first and second rails coupled to said floor support at first ends thereof and coupled to said upstanding posts, said first and second rails generally parallel and adjacent to said first and second upstanding posts, respectively;

first and second free weight holders including respective first and second riding carriages respectively and slidably coupled to said first and second rails, and being independently moveable with respect to each other when coupled to free weights said riding carriages coupling free weights to said weightlifting frame; and first and second carriage supports respectively and slidably coupled to said first and second upstanding posts, said first and second carriage supports selectably attachable to said respective first and second upstanding posts, said first and second carriage supports respectively supporting said first and second riding carriages and limiting the downward travel of said first and second riding carriages so that weight of said first and second riding carriages including weight of any free weights coupled to said first and second riding carriages may rest upon and be supported by said first and second carriage supports;

said first and second riding carriages respectively slidably engaging and pivotably rotatable about said first and second rails;

first and second free weight holding portions for holding free weights; and first and second reciprocating arm systems respectively coupling said first and second sliding carriages with said first and second free weight holding portions.

2. An exercise machine for enabling exercise with free weights as set forth in claim 1, further comprising:

said free weights being coupled to the exercise machine in a manner enabling a greater degree of freedom than would be enjoyed by said free weights were they subject to a more rigid coupling with the exercise machine.

3. An exercise machine for enabling exercise with free weights as set forth in claim 1, further comprising:

first and second counterweights respectively coupled to said first and second riding carriages, said first and second counterweights at least partially offsetting the weight of said first and second riding carriages, respectively, said first and second counterweights enabling easier adjustment respectively of said first and second riding carriages as said first and second riding carriages are slidably adjusted with respect to said first and second rails.

4. An exercise machine for enabling exercise with free weights as set forth in claim 1, further comprising:

said first and second free weight holding portions respectively and selectably coupleable to said first and second reciprocating arm systems.

5. An exercise machine for enabling exercise with free weights as set forth in claim 1, said first and second reciprocating arm systems respectively further comprising:

first and second free weight post carriages respectively coupled to said first and second riding carriages; and first and second free weight posts respectively slidably engaging said first and second free weight post carriages.

6. An exercise machine for enabling exercise with free weights as set forth in claim 5, further comprising:

said first and second free weight post carriages respectively coupled to said first and second riding carriages at an angle so as to urge said respective first and second free weight posts to travel through said first and second free weight post carriages.

7. An exercise machine for enabling exercise with free weights as set forth in claim 6, further comprising:

said first and second free weight post carriages respectively coupled to said first and second riding carriages at about 0°–8° angle so as to urge said respective first and second free weight posts to travel through said first and second free weight post carriages so that said respective first and second free weight holding portions are urged toward said first and second free weight post carriages.

8. An exercise machine for enabling exercise with free weights as set forth in claim 5, further comprising:

said first and second free weight posts respectively freely rotatable within said first and second free weight post carriages.

9. An exercise machine for enabling exercise with free weights as set forth in claim 5, further comprising:

a first lock collar selectable and lockably coupled to said first free weight post on a first rear side of said first free weight post carriage, said first lock collar restricting forward motion of said first free weight post.

10. An exercise machine for enabling exercise with free weights as set forth in claim 5, further comprising:

second lock collar selectable and lockably coupled to said first free weight post on a second front side of said first free weight post carriage, said second lock collar restricting rearward motion of said first free weight post.

11. An exercise machine for enabling exercise with free weights as set forth in claim 5, further comprising:

an alignment post coupled to said first free weight post carriage at a forward position thereof, said alignment post being generally adjacent said first free weight post;

an open fitting coupled to said first free weight holding portion and adapted to receive said alignment post; and said alignment post tending to maintain said open fitting in place when said open fitting engages said alignment post.

12. An exercise machine for enabling exercise with free comprising:

a weightlifting frame having a floor support for supporting said weightlifting frame upon a floor and first and second oppositely opposed side upstanding posts coupled together by said floor support and;

first and second rails coupled to said floor support at first ends thereof and coupled to said top upstanding posts, said first and second rails generally parallel and adjacent to said first and second upstanding posts, respectively;

first and second free weight holders including respective first and second riding carriages respectively and being independently moveable with respect to each other and being slidably coupled to said first and second rails, said riding carriages coupling free weights to said weightlifting frame, said first and second riding carriages respectively slidably engaging and pivotably rotatable about said first and second rails;

first and second counterweights respectively coupled to said first and second riding carriages, said first and second counterweights at least partially offsetting the weight of said first and second riding carriages, respectively, said first and second counterweights enabling easier adjustment respectively of said first and second riding carriages as said first and second riding carriages are slidably adjusted with respect to said first and second rails;

first and second reciprocating arm systems respectively coupling said first and second sliding carriages with said first and second free weight holding portions;

first and second free weight holding portions respectively and selectably coupleable to said first and second reciprocating arm systems, said first and second free weight holding portions for holding free weights, said free weights thereby being coupled to the exercise machine in a manner enabling a greater degree of freedom than would be enjoyed by said free weights were they subject to a more rigid coupling with the exercise machine;

first and second carriage supports respectively and slidably coupled to said first and second upstanding posts, said first and second carriage supports selectably attachable to said respective first and second upstanding posts, said first and second carriage supports respectively supporting said first and second riding carriages and limiting the downward travel of said first and second riding carriages so that weight of said first and second riding carriages including weight of any free weights coupled to said first and second riding carriages may rest upon and be supported by said first and second carriage supports;

said first and second carriage supports respectively spotting free weights held by said first and second free weight holders to enable a weightlifter to disengage said free weights in a safe and controlled manner, said first and second reciprocating arm systems respectively further comprising:

first and second free weight post carriages respectively coupled to said first and second riding carriages;

first and second free weight posts respectively slidably engaging said first and second free weight post carriages, said first and second reciprocating arm systems respectively further comprising:

said first and second free weight posts respectively freely rotatable within said first and second free weight post carriages;

an alignment post coupled to said first free weight post carriage at a forward position thereof, said alignment post being generally adjacent said first free weight post;

an open fitting coupled to said first free weight holding portion and adapted to receive said alignment post; and said alignment post tending to maintain said open fitting in place when said open fitting engages said alignment post; and a first lock collar selectable and lockably coupled to said first free weight post on a first rear side of said first free weight post carriage, said first lock collar restricting forward motion of said first free weight post; and a second lock collar selectable and lockably coupled to said first free weight post on second front side of said first free weight post carriage, said second lock collar restricting rearward motion of said first free weight post.

13. An exercise machine for enabling exercise with fixed weights slidably attached thereto comprising:

a weightlifting frame having a floor support for supporting said weightlifting frame upon a floor and first and second oppositely opposed side upstanding posts coupled together by said floor support;

first and second rails coupled to said floor support at first ends thereof, said first and second rails generally parallel and adjacent to said first and second upstanding posts, respectively;

first and second weight handles including respective first and second riding carriages respectively and slidably coupled to said first and second rails, said riding carriages coupled to said fixed weights; and first and second carriage supports respectively and being independently moveable with respect to each other and being slidably coupled to said first and second upstanding posts, said first and second carriage supports selectably attachable to said respective first and second upstanding posts, said first and second carriage supports respectively supporting said first and second riding carriages and limiting the downward travel of said first and second riding carriages so that weight of said first and second riding carriages including weight of any fixed weights coupled to said first and second riding carriages may rest upon and be supported by said first and second carriage supports, said first and second weight handles each further comprising:

first and second free weight post carriages;

first and second free weight posts respectively slidably engaging said first and second free weight post carriages; and a handle for manual engagement by a weightlifter, said handle pivotably engaging said first and second free weight posts.

14. An exercise machine for enabling exercise with free weights, comprising:

a weightlifting frame having a floor support for supporting said weightlifting frame upon a floor and having first and second oppositely opposed side upstanding posts coupled together by said floor support;

first and second rails coupled to said floor support at first ends thereof and coupled to said upstanding posts, said first and second rails generally parallel and adjacent to said first and second upstanding posts, respectively;

first and second free weight holders including respective first and second riding carriages respectively and slidably coupled to said first and second rails, said riding carriages coupling free weights to said weightlifting frame; and first and second carriage supports respectively and slidably coupled to said first and second upstanding posts, said first and second carriage supports selectably attachable to said respective first and second upstanding posts, said first and second carriage supports respectively supporting said first and second riding carriages and limiting the downward travel of said first and second riding carriages so that weight of said first and second riding carriages including weight of any free weights coupled to said first and second riding carriages may rest upon and be supported by said first and second carriage supports, said first and second free weight holders further comprising said first and second riding carriages respectively slidably engaging and pivotably rotatable about said first and second rails;

first and second free weight holding portions for holding free weights; and first and second reciprocating arm systems respectively coupling said first and second sliding carriages with said first and second free weight holding portions, said first and second reciprocating arm system respectively further comprising;

first and second free weight post carriages respectively coupled to said first and second riding carriages; and first and second free weight posts respectively slidably engaging said first and second free weight post carriages and further comprising;

a first lock collar selectable and lockably coupled to said first free weight post on a first rear side of said first free weight post carriage, said first lock collar restricting forward motion of said first free weight post.

15. An exercise machine for enabling exercise with free weights, comprising:

a weightlifting frame having a floor support for supporting said weightlifting frame upon a floor and having first and second oppositely opposed side upstanding posts coupled together by said floor support;

first and second rails coupled to said floor support at first ends thereof and coupled to said upstanding posts, said first and second rails generally parallel and adjacent to said first and second upstanding posts, respectively;

first and second free weight holders including respective first and second riding carriages respectively and slidably coupled to said first and second rails, said riding carriages coupling free weights to said weightlifting frame; and first and second carriage supports respectively and slidably coupled to said first and second upstanding posts, said first and second carriage supports selectably attachable to said respective first and second upstanding posts, said first and second carriage supports respectively supporting said first and second riding carriages and limiting the downward travel of said first and second riding carriages so that weight of said first and second riding carriages including weight of any free weights coupled to said first and second riding carriages may rest upon and be supported by said first and second carriage supports, said first and second free weight holders further comprising said first and second riding carriages respectively slidably engaging and pivotably rotatable about said first and second rails;

first and second free weight holding portions for holding free weights; and first and second reciprocating arm systems respectively coupling said first and second sliding carriages with said first and second free weight holding portions, said first and second reciprocating arm system respectively further comprising;

first and second free weight post carriages respectively coupled to said first and second riding carriages; and first and second free weight posts respectively slidably engaging said first and second free weight post carriages and further comprising;

an alignment post coupled to said first free weight post carriage at a forward position thereof, said alignment post being generally adjacent said first free weight post;

an open fitting coupled to said first free weight holding portion and adapted to receive said alignment post; and said alignment post tending to maintain said open fitting in place when said open fitting engages said alignment post.

16. An exercise machine for enabling exercise with free weights, comprising:

weightlifting frame having a floor support for supporting said weightlifting frame upon a floor and first and second oppositely opposed side upstanding posts coupled together by said floor support and;

first and second rails coupled to said floor support at first ends thereof and coupled to said top upstanding posts, said first and second rails generally parallel and adjacent to said first and second upstanding posts, respectively;

first and second free weight holders including respective first and second riding carriages respectively and being independently moveable with respect to each other and being slidably coupled to said first and second rails, said riding carriages coupling free weights to said weightlifting frame, said first and second riding carriages respectively slidably engaging and pivotably rotatable about said first and second rails;

first and second counterweights respectively coupled to said first and second riding carriages, said first and second counterweights at least partially offsetting the weight of said first and second riding carriages, respectively, said first and second counterweights enabling easier adjustment respectively of said first and second riding carriages as said first and second riding carriages are slidably adjusted with respect to said first and second rails;

first and second reciprocating arm systems respectively coupling said first and second sliding carriages with said first and second free weight holding portions;

first and second free weight holding portions respectively and selectably coupleable to said first and second reciprocating arm systems, said first and second free weight holding portions for holding free weights, said free weights thereby being coupled to the exercise machine in a manner enabling a greater degree of freedom than would be enjoyed by said free weights were they subject to a more rigid coupling with the exercise machine;

first and second carriage supports respectively and slidably coupled to said first and second upstanding posts, said first and second carriage supports selectably attachable to said respective first and second upstanding posts, said first and second carriage supports respectively supporting said first and second riding carriages and limiting the downward travel of said first and second riding carriages so that weight of said first and second riding carriages including weight of any free weights coupled to said first and second riding carriages may rest upon and be supported by said first and second carriage supports;

said first and second carriage supports respectively spotting free weights held by said first and second free weight holders to enable a weightlifter to disengage said free weights in a safe and controlled manner, said first and second reciprocating arm systems respectively further comprising:

first and second free weight post carriages respectively coupled to said first and second riding carriages;

first and second free weight posts respectively slidably engaging said first and second free weight post carriages, said first and second reciprocating arm systems respectively further comprising:

said first and second free weight posts respectively freely rotatable within said first and second free weight post carriages;

an alignment post coupled to said first free weight post carriage at a forward position thereof, said alignment post being generally adjacent said first free weight post;

an open fitting coupled to said first free weight holding portion and adapted to receive said alignment post; and said alignment post tending to maintain said open fitting in place when said open fitting engages said alignment post; and a first lock collar selectable and lockably coupled to said first free weight post on a first rear side of said first free weight post carriage, said first lock collar restricting forward motion of said first free weight post; and a second lock collar selectable and lockably coupled to said first free weight post on a second front side of said first free weight post carriage, said second lock collar restricting rearward motion of said first free weight post.

17. An exercise machine for enabling exercise with fixed weights slidably attached thereto, comprising:

a weightlifting frame having a floor support for supporting said weightlifting frame upon a floor and first and second oppositely opposed side upstanding posts coupled together by said floor support;

first and second rails coupled to said floor support at first ends thereof, said first and second rails generally parallel and adjacent to said first and second upstanding posts, respectively;

first and second weight handles including respective first and second riding carriages respectively and slidably coupled to said first and second rails, said riding carriages coupled to said fixed weights; and first and second carriage supports respectively and being independently moveable with respect to each other and being slidably coupled to said first and second upstanding posts, said first and second carriage supports selectably attachable to said respective first and second upstanding posts, said first and second carriage supports respectively supporting said first and second riding carriages and limiting the downward travel of said first and second riding carriages so that weight of said first and second riding carriages including weight of any fixed weights coupled to said first and second riding carriages may rest upon and be supported by said first and second carriage supports, said first and second weight handles each further comprising:

first and second free weight post carriages;

first and second free weight posts respectively slidably engaging said first and second free weight post carriages; and a handle for manual engagement by a weightlifter, said handle pivotably engaging said first and second free weight posts.

* * * * *